US006177622B1

(12) United States Patent
Green

(10) Patent No.: US 6,177,622 B1
(45) Date of Patent: Jan. 23, 2001

(54) BOWED STRINGED INSTRUMENT PROTECTOR AND METHOD FOR USING SAME

(76) Inventor: Matthew Daniel Green, 164 St. Botolph St., #12, Boston, MA (US) 02115

( * ) Notice: Under 35 U.S.C. 154(b), the term of this patent shall be extended for 0 days.

(21) Appl. No.: 09/179,751

(22) Filed: Oct. 27, 1998

(51) Int. Cl.[7] ..... G10G 3/00
(52) U.S. Cl. ..... 84/453; 84/274
(58) Field of Search ..... 84/453, 274, 275

(56) References Cited

U.S. PATENT DOCUMENTS

| | | | | |
|---|---|---|---|---|
| 3,728,928 | * | 4/1973 | Looser, nee Menge et al. | 84/280 |
| 3,877,501 | * | 4/1975 | Toth | 150/162 |
| 4,177,847 | * | 12/1979 | Spindler | 150/52 R |
| 4,253,371 | * | 3/1981 | Guice | 84/267 |
| 5,072,643 | * | 12/1991 | Murata | 84/293 |
| 5,103,709 | * | 4/1992 | Foss, Jr. | 84/327 |
| 5,725,094 | * | 3/1998 | Moral | 206/314 |

* cited by examiner

*Primary Examiner*—Robert E. Nappi
*Assistant Examiner*—Shih-yung Hsieh

(57) ABSTRACT

A protector device and method for using the same that prevents a bow from striking the edge of the stringed instrument in a waist region of the instrument, substantially eliminating potential harm to the instrument, such as nicks, dents, scratches, cracks and the like due to inadvertent bow strikes. A crescent-shaped device constructed and arranged to be detachably secured to a waist portion of a bowed stringed instrument sound box. The device is dimensioned such that, when installed on the stringed instrument, it prevents a bow from contacting the edge of the instrument in the belly region during normal use of the instrument. The apparatus may be a unitary member or may be a multi-layered device. In one embodiment, the protector device includes a flexible elongate outer shell and an elongate inner cushion attached to the outer shell. The apparatus is configured to be installed within the stringed instrument waist adjacent to the edge of the belly. The outer shell has a spring force urging the apparatus towards a linear configuration. This urging causes the apparatus to be retained within the waist against the edge of the belly.

31 Claims, 6 Drawing Sheets

BOWED STRINGED INSTRUMENT PROTECTOR AND METHOD FOR USING SAME

BACKGROUND OF THE INVENTION

1. Field of the invention

The present invention relates generally to musical instruments and, more particularly, to devices for use with bowed stringed instruments.

2. Related Art

Bowed stringed instruments such as the violin, viola, cello and double bass produce tones when a bow is drawn across the strings (arco) or when they are finger-plucked (pizzicato). The construction of bowed stringed instruments are quite similar. The violin, for example, includes a belly, top or soundboard defining the front of the violin, typically constructed of well-seasoned spruce; a back, usually made of well-seasoned maple; and ribs. The front, back and ribs are joined together to form a hollow sound box. Additional components of the violin include a neck, fingerboard, pegbox, scroll, bridge, tailpiece, and f-holes or soundholes.

The sound box contains a sound post and bass-bar to assist in the transmission of sound while providing additional support to the sound box construction. The sound post is a thin, dowel-like length of wood secured inside the sound box below the right side of the bridge, connecting the front and back of the violin. The bass-bar is a long strip of wood glued to the inside of the front under the left side of the bridge.

The strings of the violin are fastened to the tailpiece and pegbox. The strings rest on the bridge and are suspended over the fingerboard. At the pegbox the strings are attached to tuning pegs that can be turned to change the pitch of the string. The strings are set in vibration and produce sound when the player draws the bow across them at a right angle near the bridge. The violin has four strings tuned a fifth apart, to the notes g', d', a', e'. The bow is a narrow, slightly incurved stick of pernambuco approximately 70–75 cm long, with a band, typically horsehair, stretched from end to end of the bow stick. Sympathetic vibrations produced between the stringed instrument's top and back plates add resonance and volume to the sound.

The duration of a bowed stringed instrument's useful life and its condition during that time are directly related to the care taken to maintain and preserve the instrument. There are many conditions and circumstances to be aware of and guard against. For example, the critical effects of atmospheric changes must be considered to maintain a bowed stringed instrument in optimal condition. Various other dangers such as shocks and blows constantly threaten a bowed instrument's health.

With regard to the latter threat, of particular concern are the edges of bowed stringed instruments. The thin, fragile edges of bowed stringed instruments extend beyond the ribs and wear through the years due to constant use and damage. Cracks eventually form at the edges and travel along the top and bottom plates, degrading the performance of the instrument.

Traditionally, a purfling is inlayed into the edge of the stringed instruments to protect the edges. Because it is inlayed to approximately half the thickness of the edge, the purfling prevents further continuation of cracks that often begin at the vulnerable end grain of the plates. Although purfling tends to hinder the process of edge wear, it does not prevent initial damage to the edges themselves. Such damage may be caused by contact with the fingers and hands of the players. However, of particular concern is damage caused by the inadvertent striking of the edge with the bow during use of the instrument. For violins and violas, such contact usually occurs during vigorous up-bow strokes, while for cellos and basses, such contact usually occurs during vigorous down-bow strokes. Such contacts often nick, scratch, dent or otherwise cause permanent damage to the edges of the bowed stringed instrument. Accordingly, there is a great risk of damage to the edge of the top plate in the narrower waist region of the stringed instrument sound box between the upper and lower bouts.

Violinists, for example, often use surprising speed and force when playing the violin. A noted characteristic of the violin is its singing tone and potential to play rapid, brilliant figurations as well as lyrical melodies. For example, arco techniques such as the sul ponticello, in which the violin is played with the bow extremely close to the bridge to produce a thin, glassy sound; and the col legno, in which the violin is played with the wooded part of the bow instead of with the hair, all expose the violin to potential damage from the inadvertent striking of the instrument with the bow. To create special effects, even greater speed and force are often used, exposing the violin to even greater risks.

What is needed, therefore, is an apparatus for protecting a violin and other bowed stringed instruments from damage due to inadvertent striking of the sound box with the bow during normal use of the instrument.

SUMMARY OF THE INVENTION

The present invention is a stringed instrument protector and method for making and using the same that is detachably secured to the instrument to protect at least an edge of a top or bottom plate of the instrument. Specifically, the present invention protects an edge of a top plate of a bowed stringed instrument, particularly in a waist region of the bowed stringed instrument sound box. More specifically, the present invention prevents a bow from striking an edge of a top plate of a bowed stringed instrument in the sound box waist region thereby preventing nicks, dents, scratches, cracks and the like which may be caused during use, storage or transportation and, in particular, caused by inadvertent bow strikes during vigorous up- and down-bow strokes during use of the instrument. Thus, the present invention substantially eliminates a significant and potential harm to bowed stringed instruments.

In one aspect of the invention, a crescent-shaped device is disclosed. The device is constructed and arranged to be detachably secured to a bowed stringed instrument so as to prevent a bow from contacting the instrument during normal use of the instrument.

In another aspect of the invention, a crescent-shaped protector is disclosed. The protector is constructed and arranged to be detachably secured to a waist region of a bowed stringed instrument sound box, the sound box being formed by opposing top and bottom plates separated by ribs. The protector is dimensioned such that, when installed on the bowed stringed instrument, it covers at least the edge of the top plate in the waist region of the sound box.

In one embodiment, the protector is a flexible elongate member have a spring force urging the device towards a substantially straight or planar configuration. The protector includes a flexible elongate outer shell and an elongate inner cushion attached to the outer shell. The protector is configured to be installed within the stringed instrument waist region adjacent to the edge of the top plate. In one embodiment, the spring force is supplied by a shape memory retrained by the flexible outer shell and causes the apparatus to be retained within the waist region against the edge of the top plate. The outer shell has an interior surface and an exterior surface configured to deflect bow forces applied during normal use. The elongate inner cushion is attached to the outer shell interior surface, preventing the outer shell from contacting directly the stringed instrument when the protector is installed on the stringed instrument.

In another embodiment, the apparatus includes a flexible elongate outer shell having interior and exterior surfaces and an elongate inner cushion attached to the outer shell interior surface. The cushion prevents the outer shell from contacting directly the stringed instrument when the device is installed on the instrument. An attachment device constructed and arranged to detachably secure the apparatus against the edge of the top plate in the waist region of the instrument is also provided. The attachment device may be any one of a plurality of known devices now or later developed. In one embodiment, the attachment device is an elongate flat spring interposed between and secured to the outer shell and inner cushion. The flat spring applies a spring force that urges the apparatus to a substantially linear configuration. This causes the apparatus to apply a force against the portion of the waist region that also forms part of the upper and lower bouts. In an alternative embodiment, the attachment device includes a "U"-shaped clamp on which this protector is mounted. The clamp has substantially parallel sides that contact the top plate and bottom plate and are secured by adjustment screws. Such a clamp may of similar construction to those often used to secure chin rests to a violin. "L"-shaped clamps similar to those used with chin rests may also be used. This clamp is adapted to apply a force to a bottom plate of the sound box thereby retaining securely the apparatus against the edge of the top plate within the waist of the instrument. In a still further embodiment, the attachment device includes one or more continuous elastic bands attached to the outer shell. The elastic loops are constructed and arranged so as to be stretched from an un-stretched circumference to a stretched circumference greater than the un-stretched circumference to wrap around the sound box. This enables elastics to retain the apparatus against the edge of the top plate within the waist region of the instrument under a contraction force of the elastic loop(s) to return to their un-stretched state.

The outer shell and cushion may be constructed of any materials now or later developed. The outer shell must be sufficiently flexible to enable a person to flex the apparatus using hand force. For example, in one embodiment, the outer shell is substantially comprised of a plastic material. In alternative embodiments, other elastomeric materials are used. The cushion may be any material capable of preventing the outer shell from contacting the instrument. For example, in one embodiment, the cushion includes foam rubber, while in other embodiments a fabric or felt material is used.

In an alternative embodiment, the protector is a substantially rigid device having a radius of curvature corresponding to that of the waist region of the desired bowed stringed instrument in which the device is to be installed. In such an embodiment, the device includes attachment means other than an outwardly urging spring force to maintain the protector secured to the instrument during use of the instrument.

In another embodiment, the protector device is formed from a unitary member. In this embodiment the protector has an interior surface that contacts the stringed instrument and an exterior surface that is visible when the device is installed on the stringed instrument. Preferably the interior surface is a non-scratch surface while the exterior surface is sufficiently hard to deflect blows from the bow without substantially interfering with the overall motion of the bow during normal use. The projector may be comprised of a silicon or urethane or other material that does not scratch or otherwise mark the sound box.

In another aspect of the invention, an apparatus for attachment to a stringed instrument top plate to cover an edge of the top plate from a bowing motion is disclosed. The apparatus includes a flexible elongate outer shell and an elongate inner cushion layer. The outer shell may assume a substantially planar uninstalled position as well as a curved installed position, having a shape memory that urges it to the uninstalled position. The outer shell further has an interior surface and an exterior surface for deflecting forces applied by a bow during normal use. The elongate inner cushion layer is applied to the outer shell interior surface so as to prevent the outer shell from marking the stringed instrument when the apparatus is installed on the instrument. Due to the shape memory of the outer shell, a force applied by the outer shell is sufficient to detachably secure the apparatus in the waist region of the instrument. The outer shell is preferably constructed of an elastomeric material while the cushion is preferably comprised of a foam rubber, fabric or felt material.

In a still further aspect of the invention an apparatus for attachment to a stringed instrument waist between a top plate and ribs to protect the string instrument is disclosed. The apparatus includes a flexible elongate outer shell having an interior surface and an exterior surface. An elongate inner cushion is attached to the outer shell interior surface so as to substantially prevent the outer shell from contacting the string instrument when the apparatus is installed on the upper edge of the instrument waist. An attachment means for detachably securing the apparatus against the upper edge of the instrument waist is also included in this aspect of the invention. In one embodiment, the attachment means is an elongate flat spring interposed between the outer shell and inner cushion. The flat spring has a spring force urging the apparatus towards a substantially linear configuration. In another embodiment, the attachment means includes a bracket. The bracket is adapted to apply a force to a bottom plate of the stringed instrument, thereby retaining the apparatus to the upper edge of the waist.

In yet another aspect of the invention, a method for protecting a waist region of a bowed stringed instrument from inadvertent contact with a bow during normal use of the instrument is disclosed. The method includes the steps of: (a) flexing opposing ends of a flexible elongate protector having a non-marking surface and an opposing protective surface toward each other to curve the protector such that the non-marking surface is curved at a larger radius around an exterior of the curve and the protective surface is curved at a smaller radius around an interior of the curve. The protector has a shape memory urging it toward a substantially planar unflexed configuration. In a step (b) placing the cushion surface of the curved protector against an edge of a top plate in the waist region of the bowed stringed instrument; and (c) releasing the curved protector, enabling the shape memory to cause the protector to be retained against the top plate edge within the waist region of the instrument.

Various embodiments of the present invention provide certain advantages and overcome certain drawbacks of the conventional techniques. Not all embodiments of the invention share the same advantages and those that do may not share them under all circumstances. This being said, the present invention provides numerous advantages including the noted advantage of protecting other bowed stringed instruments from damage due to inadvertent striking of the sound box with the bow during normal use of the instrument. Specifically, embodiments of the present invention prevent a bow from striking a protected edge of the stringed instrument in a waist region of the instrument sound box. This substantially eliminates potential harm to the instrument, such as nicks, dents, scratches, cracks and the like to the edge of the instrument due to inadvertent bow strikes.

Another advantage provided by certain embodiments of the present invention is that the protector apparatus is very light and small. This enables the protector to provide the requisite protection while not interfering with the aesthetic beauty of the instrument or the quality of sound produced by the instrument. The size of the protector apparatus is dependent on a number of factors including, for example, the size of the stringed instrument, experience level of the player and the anticipated technique with which the instrument will be played. Smaller protectors are available for smaller instruments; larger protectors for larger instruments. For a given instrument, a small protector may be provided for experienced users while larger protectors are available for inexperienced users. Likewise, for a given user, a small protector may be provided for less active techniques while larger protectors are available for when the instrument is to be used with great speed and force, such as, for example, when the sul ponticello, col legno or other technique that includes vigorous up-bow or down-bow strokes are to be used to play the instrument.

A related advantage provided by certain embodiments of the invention is that the protector is a relatively small and light device that may be carried anywhere and easily stored in the carrying case of the instrument. It is anticipated that the cost of the protector would be minimal relative to the instrument itself as well as other accessories. As such, the protector is a device that may be provided by instrument makers, wholesalers, retailers, and others with the instrument to insure potential buyers, particularly novice players, do not damage the instrument.

Further features and advantages of the present invention as well as the structure and operation of various embodiments of the present invention are described in detail below with reference to the accompanying drawings. In the drawings, like reference numerals indicate identical or functionally similar elements. Additionally, the left-most one or two digits of a reference numeral identifies the drawing in which the reference numeral first appears.

BRIEF DESCRIPTION OF THE DRAWINGS

This invention is pointed out with particularity in the appended claims. The above and further advantages of this invention may be better understood by referring to the following description taken in conjunction with the accompanying drawings, in which:

DETAILED DESCRIPTION

The present invention includes an apparatus that prevents a bow or other object from striking at least an edge of a top plate of a bowed stringed instrument, preferably in a waist region of the instrument. The present invention prevents nicks, dents, scratches, cracks and the like caused by inadvertent bow strikes during normal use of the instrument, substantially eliminating a significant potential harm to the bowed stringed instrument. The present invention may be constructed and arranged to be implemented with any bowed stringed instrument. For example, the present invention may be implemented in a violin, viola, cello and double bass as well as other bowed stringed instruments. For simplicity the structure and operation of the present invention will be described in detail below with reference to a violin. Also for simplicity, all components, elements, regions, operations, etc., of bowed stringed instruments provided below are those of the violin only. As those skilled in the relevant art would find apparent, similar components, elements, regions, operations, etc. are generally provided in other bowed stringed instruments which may or may not be referred to by the same name. The skilled artisan should be capable of making the necessary correlations to implement the present invention with bowed stringed instruments beyond the violin based on the following description.

Figure 1:
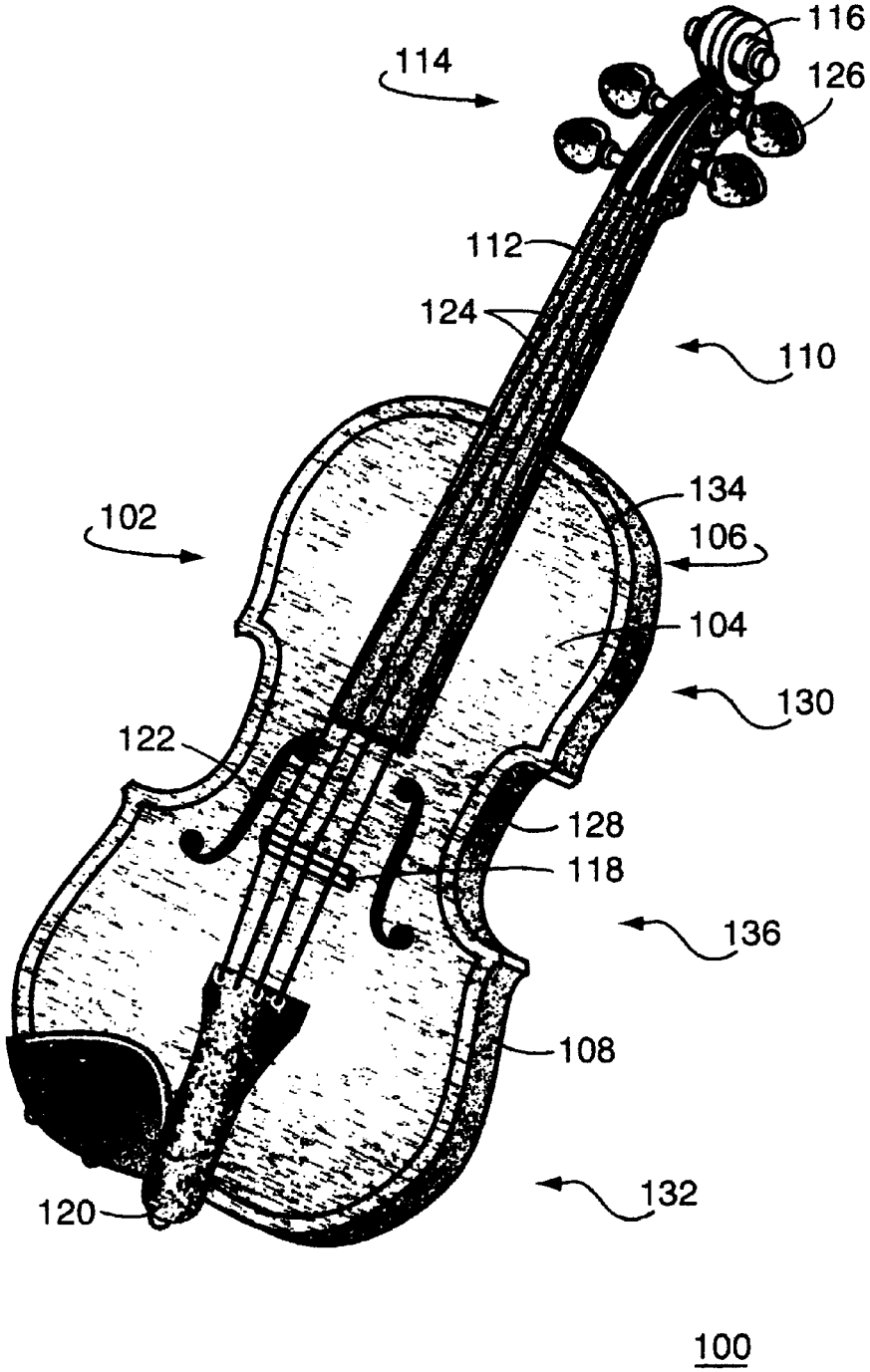
FIG. 1 is a perspective view of a violin capable of receiving embodiments of the present invention.

FIG. 1 is a perspective view of a violin suitable for implementing the present invention. A hollow sound box 102 of violin 100 is formed from a top plate 104, bottom plate 106 and ribs 108. Top plate 104, also referred to as a belly, top or soundboard, defines the front of violin 100 and is typically constructed of spruce, although other materials are also popular. Back plate 106 (not shown in FIG. 1) is substantially parallel with and opposes top plate 104. Back plate 106 is usually made of maple although, again, other materials may be and are sometimes used. Ribs 108 define the sides of the sound box 102, attached to and separating top plate 104 an bottom plate 106. Sound box 102 has an upper bout 130 and lower bout 132 separated by a narrower waist region 136.

Additional components of the violin not pertinent to the present invention include a neck 110, fingerboard 112, pegbox 114, scroll 116, bridge 118, tailpiece 120, and f-holes (or soundholes) 122. The strings are set in vibration and produce sound when the player draws the bow across them at a right angle near the bridge. Strings 124 of violin 100 are fastened to tailpiece 120 and pegs 126 on pegbox 114. Strings 124 rest on bridge 118 and are suspended over fingerboard 112. To change the pitch of a string 124, a tuning peg 126 to which it is attached is turned to tighten or loosen the string 124.

Figure 2:
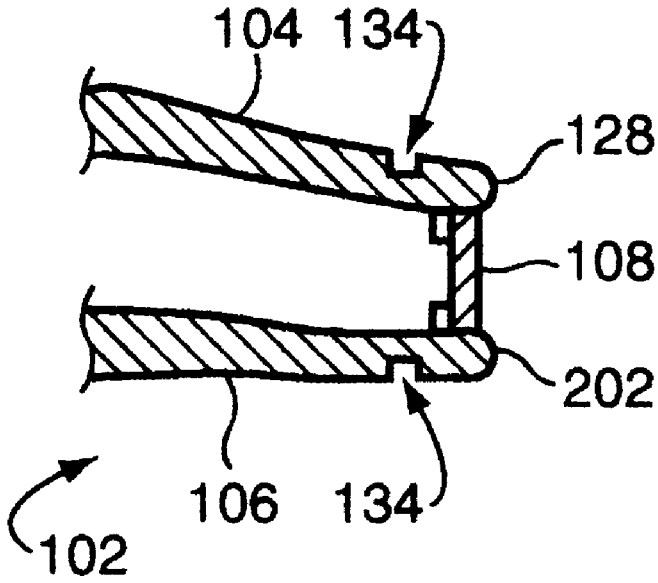
FIG. 2 is a cross-sectional view of the sound box illustrated in FIG. 1.

FIG. 2 is a partial cross-sectional view of sound box 102 showing the relationship between ribs 108 and edge 128 of top plate 104 as well as edge 202 of bottom plate 106. As noted, the condition of a bowed stringed instrument is primarily determined by the care taken to maintain and preserve the instrument over time. A particular threat to bowed stringed instruments that is substantially eliminated by the present invention is damage to edges 128 of violin 100. As shown, the thin, fragile edges 128, 202 of violin 100 extend laterally beyond ribs 108 forming a ridge that overhangs above and below ribs 108.

Edges 128 and 202 wear through the years due to constant use and damage, eventually causing cracks to form at the edges 128 and travel along the top plate 104 and bottom plate 106. To prevent migration of cracks that have already been formed at the edge 128, purfling 134 is formed into top plate 104 and bottom plate 106 near respective edges 128, 202. Although purfling tends to hinder the process of edge wear, it does not prevent initial damage to the vulnerable end grain of the edges.

Edge damage is often caused by contact with a player's fingers and hands over time. However, the greatest risk of damage is due to inadvertent striking of edge 128 of top plate 104 with the bow during normal use. The greatest risk is to top plate edge 128 in the narrower waist region 136 of violin 100 as that is the region over which the bow passes during use. Such contacts often nick, scratch, dent or otherwise cause permanent damage to edge 128, diminishing the appearance and value and, eventually, potentially adversely affecting the quality of sound produced by violin 100.

Importantly, the present invention not only protects the edges of bowed stringed instruments from damage due to handling of the instrument, it also protects the edges of the instrument from damage due to other sources of harm such as being struck by a bow during use of the instrument. The structure and operation of certain embodiments of the present invention, referred to hereinbelow as a protector, are described below. Since top plate edge 128 is of greatest risk and since its greatest threat is the bow and not the hand, embodiments of the present invention address protecting top edge 128 in waist region 136 on the side of the instrument over which the bow travels. However, it should be understood that alternative embodiments of the present invention may be constructed and arranged to protect top edge 128 at other location or regions of a bowed stringed instrument, such as around portions of upper bout 130 and lower bout 132. Alternative embodiments of the present invention may also be constructed and arranged to protect edge 202 of bottom plate 106 in the same or different regions. As will become apparent from the following description, embodiments of the protector of the present invention provide such protection by detachably securing to the bowed stringed instrument covering the desired edge portion to be protected. The protector, however, may also be configured to cover adjacent portions of the bowed stringed instrument. For example, embodiments of the protector may also protect a portion of top plate 104 and/or a portion of ribs 108 adjacent to edge 128.

Figure 3A:
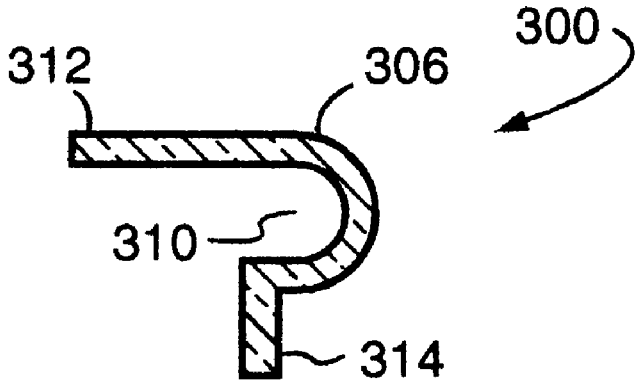
FIGS. 3A–3B are cross-sectional views of two embodiments of the protector of the present invention.
Figure 3B:
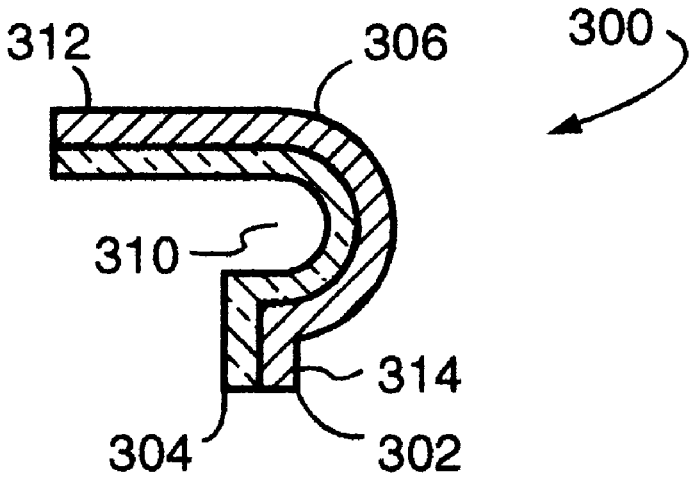
Figure 4:
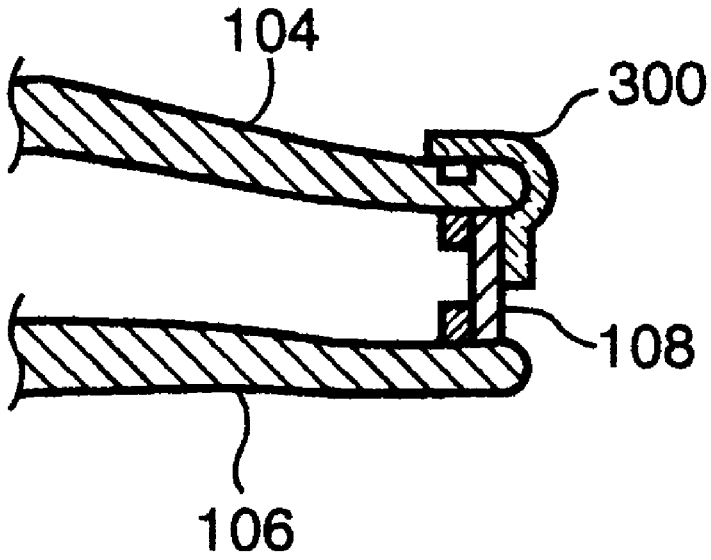
FIG. 4 is an cross-sectional view of a portion of the sound box with the protector of the present invention secured over the edge of the top plate.
Figure 5:
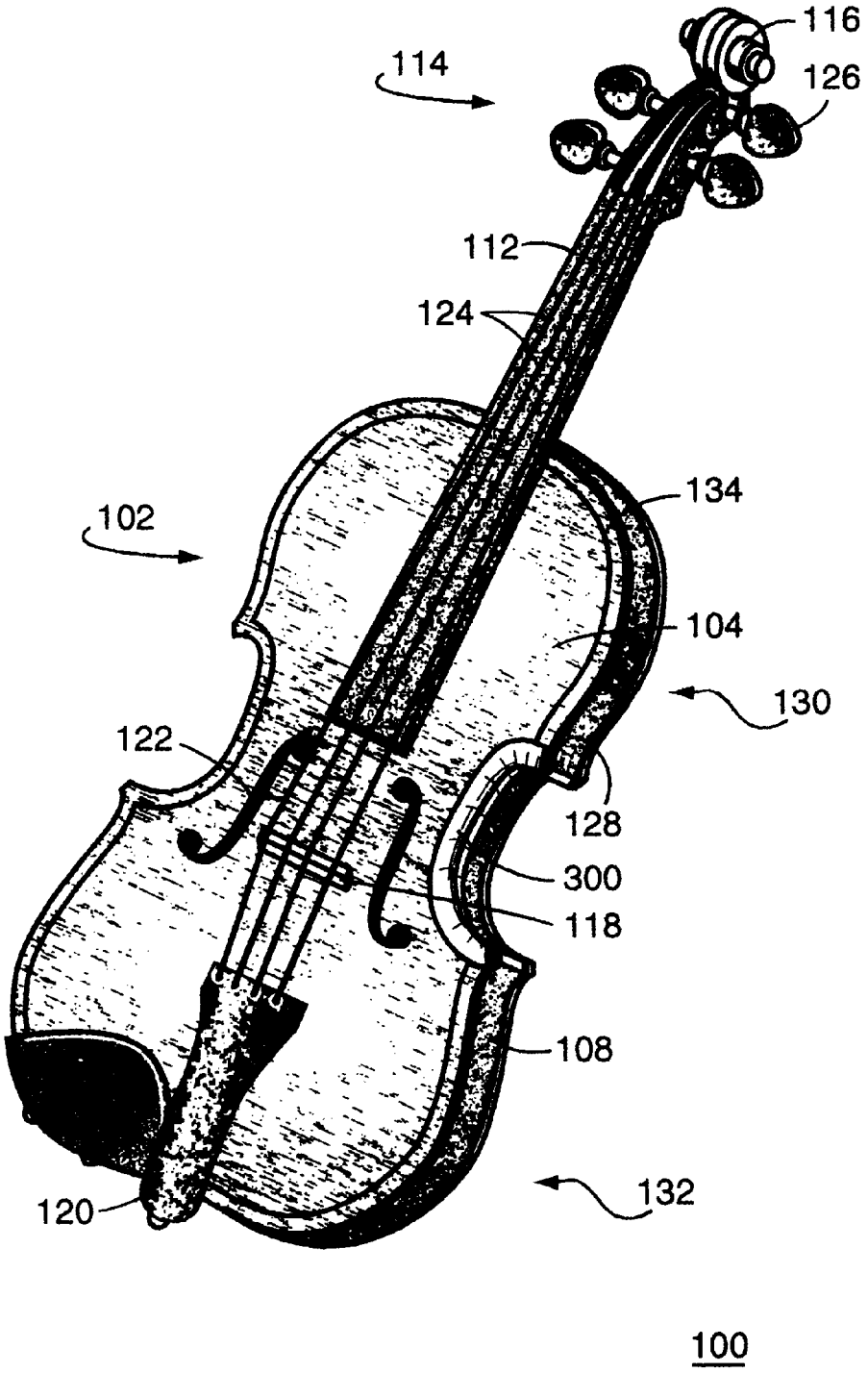
FIG. 5 is a perspective view of the violin shown in FIG. 1 with one embodiment of the protector of the present invention installed within a waist region of the violin sound box.
Figure 6:
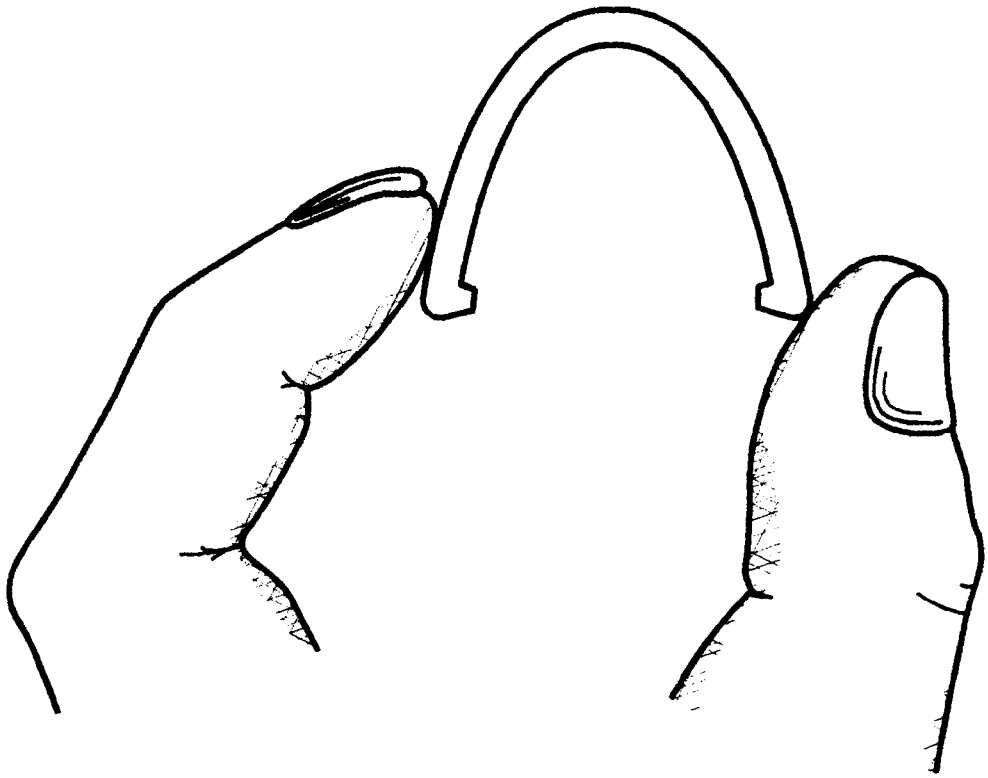
FIG. 6 is a perspective view of a person flexing one embodiment of the protector for installation within a waist region of a bowed stringed instrument.

Embodiments of the protector will now be described with reference to FIGS. 3A–6. FIGS. 3A–3B are cross-sectional views of various embodiments of a protector 300 of the present invention. FIG. 4 is a cross-sectional view of violin 100 with protector 300 installed over top plate 104 to protect edge 128. FIG. 5 is a perspective view of protector 300 installed on violin 100. FIG. 6 is an illustration of how a flexible protector may be flexed prior to insertion into waist region 136 of violin 100.

Referring to FIGS. 3A–3B, two illustrative embodiments of a protector 300 are shown. In FIGS. 3A–3B protector 300 is oriented generally as it would be when installed on violin 100. Generally, protector 300 includes an upper extension 312 and a lower extension 314 joined by a curved region 306. Upper extension 312 contacts a surface of top plate 104, extending a predetermined distance over top plate 104. Likewise, lower extension 314 extends a predetermined distance from curved region 306 to cover a portion of ribs 108. Curved region 306 is shaped in the form of a "C" or "U" to define a curved recess 310 adapted to receive edge 128. As such, when installed as shown in FIG. 4, protector 300 wraps around edge 128 to cover completely edge 128 as well as a portion of top plate 104 and a portion of ribs 108, thereby protecting the covered portion of edge 128. As shown in FIG. 5, when installed, the illustrative embodiment of protector 300 is a substantially crescent-shaped protector detachably secured to the sound box 102 to cover a top plate edge 128 in a waist region 136 of sound box 102. Protector 300 prevents a bow from contacting the covered top plate edge 128 during normal use of the instrument.

Referring again to FIGS. 3A and 3B, protector 300 may be formed from a single, unitary member as shown in FIG. 3A or may be formed as a multi-layered device a shown in FIG. 3B. In addition, protector 300 may be a substantially rigid device, having a length and radius of curvature corresponding to that of waist region 136 of violin 100. Preferably, however, protector 300 is flexible, yielding under the finger strength of a player so that it may be easily installed within waist region 136 and, when released, conform to the curvature of waist region 136.

In the embodiment illustrated in FIG. 3A wherein protector 300 is a single, unitary member, the interior surface of protector 300 that contacts violin 100 when protector 300 is installed on the instrument 100 has a non-scratch surface to prevent protector 300 from scratching or otherwise marking or damaging violin 100. The exterior surface of protector 300 is sufficiently hard to deflect the bow without substantially interfering with the overall motion of the bow.

In one preferred embodiment, protector 300 is a multi-layered device. Referring to FIG. 3B, this embodiment includes two layers: an elongate outer shell 302 and an elongate inner cushion 304. Outer shell 302 has an exterior surface configured to deflect bow forces applied during normal use. The inner cushion 304 is attached to an interior surface of outer shell 302, preventing outer shell 302 from marking violin 100 when protector 300 is installed on violin 100.

As shown in FIGS. 3A–5, protector 300 preferably has a minimal cross-section. This minimizes the degree to which protector 300 interferes with the normal use of violin 100. In addition, it is preferable that protector 300 is comprised of light-weight materials. This will not only assist in the reducing the cost of manufacturing and shipping, but also reduce any potential adverse effects of protector 300 on the performance of violin 100.

The present invention also includes a means (not shown) for attaching the protector to violin 100. In the embodiment in which protector 300 is a flexible device, protector 300 is detachably secured to violin 100 due to a shape memory retained by outer shell 302. This shape memory causes outer shell 302 to urge protector 300 towards a substantially planar, uninstalled position. This causes the protector 300 to secure itself within waist region 136 against edge 128.

In alternative embodiments, other devices in addition to or instead of the shape memory of the flexible outer shell may be used. For example, in one embodiment an attachment device that maintains the protector detachably secured to the instrument during normal use is an elongate flat spring interposed between and secured to outer shell 302 and said inner cushion 304. The flat spring has a spring force that urges protector 300 to a substantially linear configuration; that is, to its uninstalled position. This causes protector 300 to confirm to the edge 128 in waist region 136, thereby assuming a substantially crescent-like shape.

In an alternative embodiment, protector 300 may be detachably secured to violin 100 through use of a clamp. Numerous types of clamps may be used. In one particular embodiment, the clamp is an "L"- or "U"-shaped bracket with barrels similar to those commonly used to secure a chin rest to a violin. Once the protector is placed adjacent to edge 128, screws are rotated so that the lower arm extend below sound box 102 and contacts back plate 106. The clamp or bracket applies a force to bottom plate 106 of sound box 102 thereby retaining protector 300 against top plate edge 128 within waist region 136 of violin 100.

In another embodiment, the attachment means includes one or more elastic loops attached to protector 100. The elastic loops are configured to be stretched to a circumference greater than their unstretched circumference larger than the diameter of sound box 102. The elastics can then be wrapped around sound box 102 to retain protector 100 to top plate edge 128 under a contraction force of the elastic loops. Numerous other devices and techniques may be used to detachably secure protector 300 to violin 100.

Protector 300 maybe manufactured from any combination of materials. In the embodiment illustrated in FIG. 3A, for example, protector 300 may be comprised of silicon or urethane or other material or composite that is not sufficiently hard or rough to scratch or otherwise mark violin 100. It should be understood that different woods are often used for top plate 104 and ribs 108; accordingly, protector 300 must be of a material that would not mark any of such materials.

In the multi-layered embodiment illustrated in FIG. 3B, outer shell 302 may be constructed of an elastomeric material such as a plastic. Many other materials may be used in addition to or instead of plastic. Inner cushion 304 may be any material that protects violin 100 from outer shell 302. For example, in one preferred embodiment, outer shell 304 is a plastic having a hardness that is sufficient to deflect forces applied by a bow. In such embodiments, cushion layer 304 is a foam rubber or felt. The foam rubber may be glued or otherwise secured to the inner surface of outer shell 302. In one embodiment, the foam rubber is sprayed on sheets of plastic prior to stamping or cutting the plastic into lengths of strips. As one skilled in the relevant art would find apparent, cushion layer 304 may be comprised of other materials in addition to or instead of foam rubber. For example, cushion layer 304 may include a fabric, styrofoam, etc. It should also be understood that the thickness of cushion layer 304 is to be selected based on the materials used in outer shell 302, type of wood of the instrument in which it will be implemented, the manner in which the instrument is to be played, etc.

In use, the protector 300 is flexed by the player as shown in FIG. 6 and inserted into waist region 136 so that served region 310 receives edge 128 and upper extension 312 contacts top plate 104 and lower extension 314 contacts ribs 108. The protector is then released, enabling it to return towards the unflexed position due to its shape memory. The protector 300 is securely held within the waist region 136. In embodiments where other attachment devices are implemented, then such devices are operated to secure the protector 300 to the violin 100.

While various embodiments of the present invention have been described above, it should be understood that they have been presented by way of example only, and not limitation. Thus, the breadth and the scope of the present invention are not limited by any of the above exemplary embodiments, but are defined only in accordance with the following claims and their equivalents.

What is claimed is:

1. An elongate crescent-shaped device constructed and arranged to be detachably secured to a waist region of a bowed stringed instrument to cover an edge of a top plate of the instrument so as to prevent a bow from contacting the edge of the instrument during normal use of the instrument.

2. The device of claim 1, wherein said device is a unitary device having an interior surface for contacting the bowed string instrument, and an exterior surface for deflecting the bow during normal use of the instrument.

3. A protector constructed and arranged to be detachably secured to a bowed stringed instrument, said protector is an elongate cresent-shaped device constructed and arranged so as to cover a top plate edge in a waist region of the bowed stringed instrument sound box.

4. The protector of claim 3, wherein said protector has a cross-section such that, when installed on the instrument, said protector does not extend from the top plate edge into a path in which a bow travels during normal use of the instrument, thereby not interfering substantially with the normal use of the bowed stringed instrument.

5. The protector of claim 4, further comprising:

an elongate inner cushion attached to said outer shell interior surface, said cushion preventing said outer shell from contacting the string instrument when the protector device is installed on the instrument.

6. The protector of claim 5, wherein said cushion is comprised of a foam rubber material.

7. The protector of claim 5, wherein said cushion is comprised of a felt material.

8. The protector of claim 3, comprising:

a flexible elongate outer shell having a spring force urging said outer shell to a substantially linear configuration so as to retain said protector within the waist region against the edge of the top plate, said outer shell having an interior surface and an exterior surface configured to deflect bow forces applied during normal use.

9. The protector of claim 8, wherein said outer shell is constructed of a plastic material.

10. The protector of claim 3, wherein said protector is a substantially rigid device having a radius of curvature corresponding to that of the waist region of the bowed stringed instrument.

11. The protector of claim 10, wherein said protector comprises an attachment device that maintains said protector detachably secured to the instrument during normal use.

12. The protector of claim 10, wherein said protector comprises a silicon material.

13. The protector of claim 10, wherein said protector comprises a urethane material.

14. The protector of claim 3, wherein said protector is formed from a unitary member.

15. The protector of claim 14, wherein said protector comprises:

an interior surface that contacts the bowed stringed instrument when said protector is installed on the instrument; and an exterior surface visible when the protector is installed on the instrument, wherein said interior surface has a non-scratch surface and wherein said exterior surface is sufficiently hard to deflect the bow without substantially interfering with the overall motion of the bow.

16. The protector of claim 3, comprising:

a flexible elongate outer shell having an interior surface and an exterior surface configured to deflect bow forces applied during normal use;

an elongate inner cushion attached to said outer shell interior surface, said cushion preventing said outer shell from marking the instrument when the protector is installed on the instrument; and an attachment device constructed and arranged to detachably secure the protector against the edge of the top plate within the waist region of the instrument.

17. The protector of claim 16, wherein said attachment device comprises:

an elongate flat spring interposed between and secured to said outer shell and said inner cushion, said flat spring having a spring force urging said protector to a substantially straight configuration.

18. The protector of claim 16, wherein said attachment device comprises:

an elongate flat spring formed within said outer shell, said flat spring having a spring force urging said protector to a substantially straight configuration.

19. The protector of claim 16, wherein said attachment device comprises:

a clamp secured to the attachment device, said clamp constructed and arranged such that, when said protector is installed on the instrument, said clamp applies a force to a bottom plate of the sound box thereby retaining the protector against the top plate edge.

20. The protector of claim 16, wherein said attachment device comprises:

an elastic loop attached to said outer shell, said elastic loop constructed and arranged such that, when the protector is installed on the instrument, said elastic loop is stretched to a circumference greater than a natural circumference to wrap around the sound box, thereby retaining said protector to the top plate edge within the waist region of the instrument under a contraction force of said elastic loop.

21. The protector of claim 3, wherein said protector is a unitary device having an interior surface for contacting the bowed string instrument, and an exterior surface for deflecting the bow during normal use of the instrument.

22. An apparatus for attachment to a stringed instrument top plate to cover the top plate edge from a bowing motion, the apparatus comprising:

a flexible elongate outer shell including a substantially planar uninstalled position, a curved installed position, and a shape memory urging said outer shell to said uninstalled position, said outer shell further having an interior surface and an exterior surface for deflecting forces applied by a bow during normal use; and an elongate inner cushion layer applied to said outer shell interior surface so as to prevent said outer shell from marking the stringed instrument when the apparatus is installed on the instrument, wherein said shape memory of said outer shell causes said outer shell to apply a force to said instrument waist region sufficient to detachably secure the apparatus in the waist of the instrument.

23. The apparatus of claim 22, wherein said outer shell is constructed of an elastomeric material.

24. The apparatus of claim 22, wherein said cushion is comprised of a foam rubber material.

25. The apparatus of claim 22, wherein said cushion is comprised of a fabric material.

26. The apparatus of claim 22, wherein said apparatus is a unitary device having an interior surface for contacting the bowed string instrument, and an exterior surface for deflecting the bow during normal use of the instrument.

27. An apparatus for attachment to a bowed stringed instrument waist region to cover and protect a top plate edge and at least a portion of the ribs in the waist region, the apparatus comprising:

a flexible elongate outer shell having an interior surface and an exterior surface; and an elongate inner cushion attached to said outer shell interior surface so as to prevent said outer shell from contacting the string instrument when the apparatus is installed on the upper edge of the instrument waist.

28. The apparatus of claim 27, wherein said attachment means comprises:

a bracket hinged to a bottom edge of said outer shell, said bracket constructed and arranged to apply a force to a bottom plate when the apparatus is installed on the instrument, thereby retaining the apparatus to the upper edge of the waist.

29. The apparatus of claim 27, further comprising:

attachment means for detachably securing the apparatus against the upper edge of the instrument waist.

30. The apparatus of claim 29, wherein said attachment means comprises:

an elongate flat spring interposed between said outer shell and said inner cushion, said flat spring having a spring force urging said apparatus to a substantially linear configuration.

31. A method for protecting a waist region of a bowed stringed instrument from inadvertent contact with a bow during normal use of the instrument, the method comprising the steps of:

(a) flexing opposing ends of a flexible elongate protector having a non-marking surface and an opposing protective surface toward each other to curve said protector such that said non-marking surface is curved at a larger radius around an exterior of the curve and said protective surface is curved at a smaller radius around an interior of the curve, said protector having a shape memory urging it toward a substantially planar unflexed configuration;

(b) placing said cushion surface of said curved protector against an edge of a top plate in the waist region of the bowed stringed instrument; and (c) releasing said curved protector, enabling said shape memory to cause said protector to be retained against the top plate edge within the waist region of the instrument.

* * * * *